United States Patent [19]

Huggins

[11] Patent Number: 4,513,404

[45] Date of Patent: Apr. 23, 1985

[54] ACOUSTIC REFLECTOMETER FOR SHEET FEED SENSING

[75] Inventor: Raymond W. Huggins, Pittsford, N.Y.

[73] Assignee: Xerox Corporation, Stamford, Conn.

[21] Appl. No.: 474,914

[22] Filed: Mar. 14, 1983

[51] Int. Cl.[3] ..... G08B 21/00

[52] U.S. Cl. ..... 367/93; 271/259; 340/674

[58] Field of Search ..... 340/674; 367/93; 271/259, 258

[56] References Cited

U.S. PATENT DOCUMENTS

| | | | |
|---|---|---|---|
| 3,479,026 | 11/1969 | Plummer et al. | 271/58 |
| 3,603,680 | 9/1971 | Barton | 355/3 |
| 3,914,754 | 10/1975 | Kirk | 367/93 |
| 4,016,529 | 4/1977 | Inuzuka et al. | 367/93 |
| 4,066,969 | 1/1978 | Pearce et al. | 340/674 |

*Primary Examiner*—Glen R. Swann, III
*Attorney, Agent, or Firm*—Ronald F. Chapuran

[57] ABSTRACT

The present invention is concerned with a single sensor transmitter and receiver connected to a pneumatic bus. The pneumatic bus includes a plurality of sensor locations or ports disposed at various points along the paper path in a machine. The acoustic impedance characteristic at each port is modified by the absence or close proximity of a sheet of paper. In a twin tube pneumatic bus version of the invention, there is a transmitting transducer connected to a transmitting tube and a receiving transducer connected to a receiving tube. Communication between the transmitting and receiving tubes is made through the oppositely disposed orifices or ports disposed along the paper path. Each of the transmitting and receiving tubes includes associated, oppositely disposed orifices, each pair of oppositely disposed orifices providing a port for determining the presence or absence of a sheet of paper. With no paper at a particular port, the transmitted signal is conveyed from the transmitter tube through the orifices to the receiver tube and back to the receiver. With paper in the path, between one or more of the pairs of orifices, the signal received by the receiving transducer is modified. In another embodiment, a single tube is used having one transducer connected to one end of the tube serving as both transmitter and receiver. Paper is detected by a change in the acoustic impedance of the tube orifice when paper is absent or in close proximity to the port. This impedance change results in a modification of the reflection of the signal from the port. One method of determining which of the orifices experiences the impedance change, or which pair of orifices is shielded is by pulsing the transmitting transducer, and time resolving the received signal.

11 Claims, 9 Drawing Figures

ACOUSTIC REFLECTOMETER FOR SHEET FEED SENSING

BACKGROUND OF THE INVENTION

This invention relates to a detection system and, in particular, to an acoustic reflectometer sensor for detecting the presence of objects such as a paper in a paper path.

In machines requiring the movement of sheets of paper in timed sequence, such as printers and reproduction machines, paper jamming often occurs due to improper paper feeding, spacing inaccuracies, and various other factors resulting in the improper deceleration or acceleration of paper sheet speeds in the machine.

The prior art is replete with paper sensing devices to sense the presence of sheets of paper at various points along the path of travel. One type of sensing device takes the form of switches actuated by switch arms located in the path of movement of the sheet. The disadvantages of this type of sensor are the response time of the control to the mechanical actuation of the switch by the paper. Also, the fact that the sheet of paper must contact a switch arm itself may effect the travel of the sheet, either retarding the advancement of the sheet or skewing the sheet out of the predetermined path.

Other sheet detection systems utilize photodetectors combined with light sources for sensing sheet presence or absence. One disadvantage of this type of sensor is the accumulation of dust and other material decreasing the sensitivity of the device. Another disadvantage is that the photodetector, light source pair will not in general sense transparent or translucent sheets of paper. Also, in particular in photocopy machines, it is often necessary to provide light baffles or other enclosures to insure that the machine photosensitive surface does not come into light contact with the light sources of the sensors.

Other types of detection devices such as disclosed in U.S. Pat. No. 3,603,680 teach the use of a plurality of ultrasonic detecting devices dispersed along the path. Each of the detecting devices includes an ultrasonic transmitting transducer for generating ultrasonic waves of a predetermined wavelength and an ultrasonic receiving transducer to receive the transmitted waves. The acoustically vibrating element in each of the transducers is generally a piezoelectric material for converting electrical signals to mechanical vibrations or mechanical vibrations to electrical signals. The detection devices are arranged along the paper path and circuit means monitor in timed sequence the effect upon each of the detection devices as sheets are transported.

Other sensors such as disclosed in U.S. Pat. No. 3,479,026 teach the use of a hollow tube attached to a speaker. In operation, the speaker is driven at constant frequency and the acoustical impedance of the hollow tube is measured by measuring the electrical impedance of the speaker. When a document moves along the paper path and covers one end of the hollow tube, the acoustical impedance and thus the electrical impedance is changed. A difficulty with this type of system and other prior art systems is that it is necessary to provide a separate transmitter and/or receiver along each port or location of the paper path where it is desired to sense the presence or absence of a sheet of paper. This can be relatively complicated and expensive.

It would be desirable, therefore, to provide a paper sensing system that is simple and relatively inexpensive and provides the means to detect the presence or absence of paper at several ports along a paper path without the need to provide a separate transmitter and receiver at each port.

SUMMARY OF THE INVENTION

It is, therefore, an object of the present invention to provide a new and improved paper sensor, and in particular an acoustic reflectometer paper path sensor using a common pneumatic bus serially connecting several ports along the paper path.

Further advantages of the present invention will become apparent as the following description proceeds, and the features characterizing the invention will be pointed out with particularity in the claims annexed to and forming a part of this specification.

Briefly, the present invention is concerned with a single sensor transmitter and receiver connected to a pneumatic bus. The pneumatic bus includes a plurality of sensor locations or ports disposed at various points along the paper path in a machine. The acoustic impedance characteristic at each port is modified by the absence or close proximity of a sheet of paper. In a twin tube pneumatic bus version of the invention, there is a transmitting transducer connected to a transmitting tube and a receiving transducer connected to a receiving tube. Communication between the transmitting and receiving tubes is made through the oppositely disposed orifices or ports disposed along the paper path. With no paper at a particular port, the transmitted signal is conveyed from the transmitter tube through the orifices to the receiver tube and back to the receiver. With paper in the path, there is no communication of the signal from the transmitting tube to the receiving tube, through one or more of the pairs of orifices, the signal being blocked by the paper. Each of the transmitting and receiving tubes includes associated, oppositely disposed orifices, each pair of oppositely disposed orifices providing a port for determining the presence or absence of a sheet of paper. In another embodiment, a single tube is used having one transducer connected to one end of the tube serving as both transmitter and receiver. Paper is detected by a change in the acoustic impedance of one or more of the tube orifices when paper is absent or in close proximity to the port. This impedance change results in a modification of the reflection of the signal from the port. The impedance change of any port is resolved by pulsing the transmitter and looking at the time period for reflections from each port.

BRIEF DESCRIPTION OF THE DRAWINGS

For a better understanding of the present invention, reference may be had to the accompanying drawings wherein the same reference numerals have been applied to like parts and wherein:

FIG. 3 *a* is another embodiment of the reflectometer sensor;

FIG. 3*b* is an illustration of the timing of the transmitted acoustic pulses in FIG. 3*a.

DESCRIPTION OF THE PREFERRED EMBODIMENTS

Figure 1A:
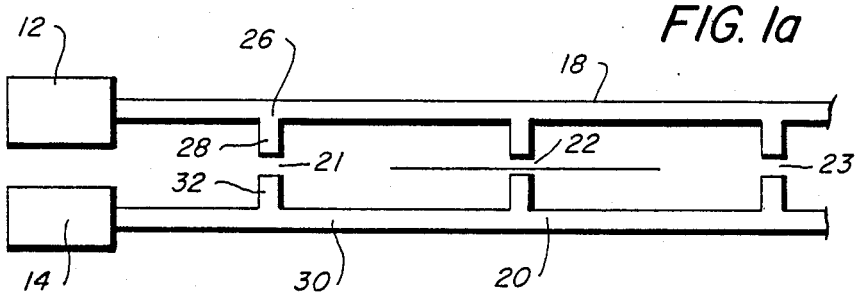
FIG. 1*a* is the twin tube embodiment of the reflectometer sensor in accordance with the present invention.

With reference to FIG. 1*a,* there is shown a twin tube embodiment of the present invention. In particular the sensor includes a separate transmitting transducer or transmitter 12 and a separate receiving transducer or receiver 14. The transmitter 12 can be any suitable source of pulsed acoustic energy such as a piezoelectric or electromagnetic device or minature loud speaker. The receiver 14 can be any suitable receiver of pulsed acoustic energy such as a microphone. A twin tube generally shown at 16 interconnects the acoustic transmitter 12 with the acoustic receiver 14. The twin tube is preferably a polymerized vinyl compound or plastic that provides a suitable acoustic wave guide.

As illustrated, the twin tube comprises a transmitter line 18 receiving the transmitted acoustic energy from the transmitter 12 and a receiver line 20 for conveying the transmitted acoustic energy from the transmitter back to the receiver 14. The connection between the transmitter line 18 and the receiver line 20 is via any several connections or ports illustrated at 21, 22 and 23.

In a preferred embodiment, at each of the ports, a suitable tee or connector is inserted in the transmitter line 18 and the receiver line 20. For example, at port 21 a tee or connector 26 is inserted such that the base of the connector interconnects with the transmitter line 18 and the leg 28 of the connector 26 extends downwardly as illustrated toward the receiver line. In a similar manner, a tee or connector is inserted such that the base of the connector 30 interconnects with the receiver line 20 and the leg 32 of the connector 30 extends upwardly toward the transmitter line 18.

The ends of the legs 28 and 32 are aligned in close relation providing oppositely disposed orifices. In operation, if the sensor detects the presence or absence of paper, the ends of the legs 28 and 32 would be disposed as close as possible while still allowing a sheet of paper to traverse between the legs. It should be noted that for a separate transmitter 12 and receiver 14 several ports or detector locations could be located along the transmitter line 18 and receiver line 20. It should also be noted that the ports could be used to detect not only paper but other occurrences such as the opening or closing of a door interlock.

The presence of paper or any other object is sensed by the interruption of the transmitted pulses from the transmitter 12 to the receiver 14. For example, in FIG. 1*a,* a pulse emitted from the transmitter 12 traveling down the transmitter tube line 18 is conveyed from the transmitter tube line 18 to the receiver tube line 20 through port 21 but is blocked from transmission to the tube line 20 at port 22 by the presence of the paper at port 22.

Figure 1B:
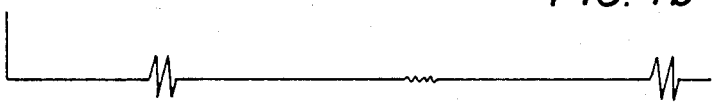
FIG. 1*b* is an illustration of the timing of received signals in accordance with the embodiment of FIG. 1*a;*
Figure 1C:
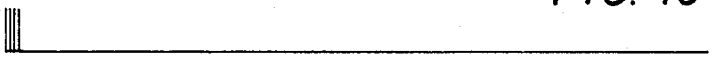
FIG. 1*c* is an illustration of the timing of the transmitted acoustic pulse.

With reference to FIGS. 1*b* and 1*c,* there are shown timing diagrams illustrating the timing relationships for the ports 21, 22 and 23 illustrated in FIG. 1*a.* For example, assuming the distance from the transmitter 12 to the port 21 is d and the return distance from the port 21 to the receiver 14 is also d, then the time t, for the pulse from the transmitter 12 to travel from the transmitter 12 to the receiver 14 via port 21 is 2d divided by the velocity of the pulse.

$$t=2d/V$$

In other words, at time 2d/V the receiver 14 will receive an acoustic signal as illustrated in FIG. 1*b,* indicating there is no paper or other obstruction at port 21. FIG. 1*c* illustrates the pulse at the transmitter 12. On the other hand, since port 22 is obstructed by paper, an attenuated signal will be received by the receiver 14 corresponding to port 22. Assuming the distance between port 21 and port 22 is d′, then the time t′, for the pulse from transmitter 12 to travel from the transmitter 12 to the receiver 14 via port 22 is 2d plus 2d′ divided by the velocity of the pulse. That is $$t' \frac{2(d+d')}{V}$$

At time 2(d+d′)/V, the receiver 14 monitors port 22 and if no signal is received or very minimal signal is received as illustrated in FIG. 1*b,* the receiver 14 senses that there is an obstruction at port 22. Similarly, if the distance from port 22 to the port 23 is d″, the time period t″ for the transmission of a transmitted pulse from transmitter 12 to reach receiver 14 is 2(d+d′+d″)/V, i.e.

$$t'' \frac{2(d+d'+d'')}{V}$$

Therefore, by sensing the receiver signals at times t, t′ and t″, the simultaneous presence of paper at any of the ports 21, 22 or 23 can be detected.

Figure 2A:
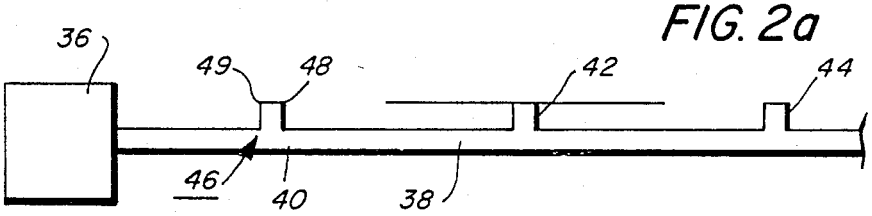
FIG. 2*a* is a single tube embodiment of the reflectometer sensor in accordance with the present invention.
Figure 2B:
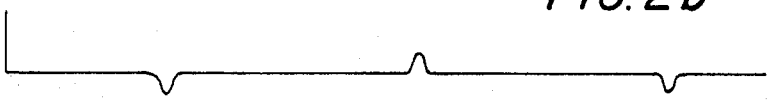
FIG. 2*b* is an illustration of the timing of received signals in accordance with the embodiment of FIG. 2*a;*

With reference to FIGS. 2*a,* 2*b* and 2*c* there is illustrated a single tube embodiment in accordance with the present invention. In particular, a combined acoustic energy transmitter and receiver is illustrated at 36 connected to a single tube acoustic wave guide 38. The transmitter/receiver 36 is any suitable means to generate and receive pulsed acoustic energy such as a piezoelectric device and the tube 38 is any suitable acoustic wave guide.

Suitable acoustic pulses are generated by the transmitter receiver 36 and conveyed along the wave guide 38 to various ports illustrated at 40, 42 and 44. The ports 40, 42 and 44 are similar to the ports of FIG. 1*a* except that there is only one tee connector for each port. For example, at port 40 there is a connector 46 with leg portion 48 terminating in an orifice 49. The presence or absence of paper or any other obstruction at orifice 49 will modify the reflected signal monitored by the transmitter/receiver 36.

Figure 2C:
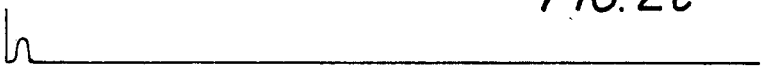
FIG. 2*c* is an illustration of the timing of the transmitted acoustic pulse.

At port 40, the acoustic pulses are reflected back to the transmitter/receiver 36. However, since there is no obstruction at port 40, there is an inverted reflection. The sign of the reflected pulse is changed, i.e. a positive presence pulse becomes a negative presence pulse. Assuming the distance from the transmitter receiver 36 to the port 40 is d, the time for the acoustic pulse to travel to port 40 and return, as in FIG. 1*b,* is 2d/V where V is the velocity of the acoustic pulse. Therefore, at a time 2d/V, as shown in FIGS. 2*a,* and 2*b* the receiver monitors the return pulse and if it is an inverted reflection of an transmitted pulse, an unobstructed port 40 is recognized. FIG. 2*c* illustrates the transmitted acoustic pulse.

On the other hand, at port 42, there is illustrated an obstructed port. Thus, the return signal is non-inverted signal and again, assuming the distance between port 40 and port 42, is d', the time for the acoustic pulse to travel to port 42 and return as in FIG. 1*b* is 2(d+d')/V. The obstruction at port 42 can be paper as illustrated in FIG. 1*b*, or any other type of obstruction such as a door interlock.

In short, the impedance change results in a modification of the reflected acoustic pulse from the port. An obstruction at a port is detected by a change in the acoustic impedance from the impedance when there is no obstruction.

Figure 3A:
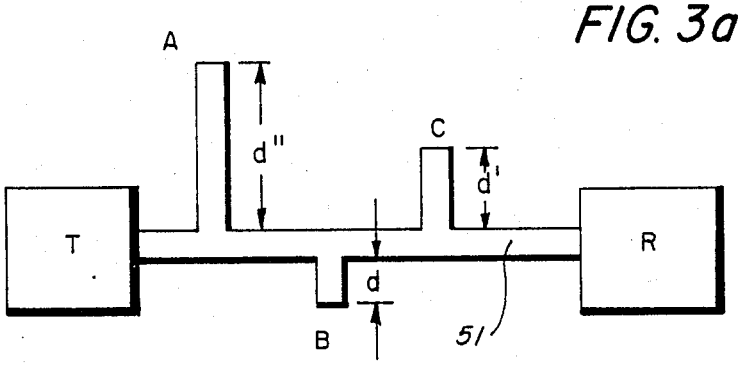
Figure 3B:
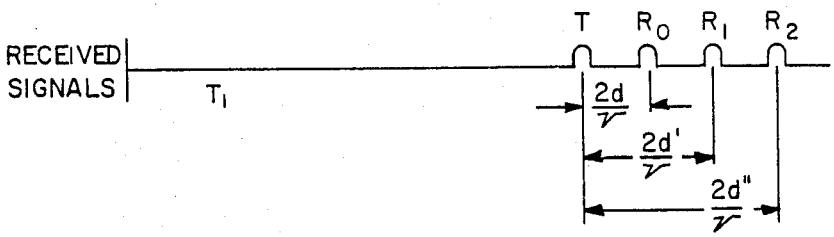

With reference to FIGS. 3*a* and 3*b*, there is another embodiment of the present invention. Transmitter T produces pulses carried over transmission tube 51. Disposed along tube 51 are ports A, B and C. In operation, a pulse transmitter from transmitter T that is conveyed directly to receiver R will arrive at receiver R in time $T_1$, as illustrated in FIG. 3B. Since the distance from port B to tube 51 is d, the time of arrival of pulses from port B to receiver R will be $t=T_1+2d/V$ where V is the velocity of the pulse. This is illustrated by pulse $R_o$ in FIG. 3*b*.

Also, since the distance from port C to tube 51 is d', the time period of arrival of a pulse from transmitter T to port C to receiver R is $$t'=T_1+2d'/V$$

where V is the velocity of the pulse. This is illustrated by the pulse $R_1$ in FIG. 3*b*. Similarly, pulse $R_2$ represents the time of arrival of a pulse from transmitter T via port A.

By analyzing whether the received pulse is inverted or non-inverted and the time of arrival, it is possible to determine absence or presence of an obstruction at each of the ports A, B and C.

Figure 4:
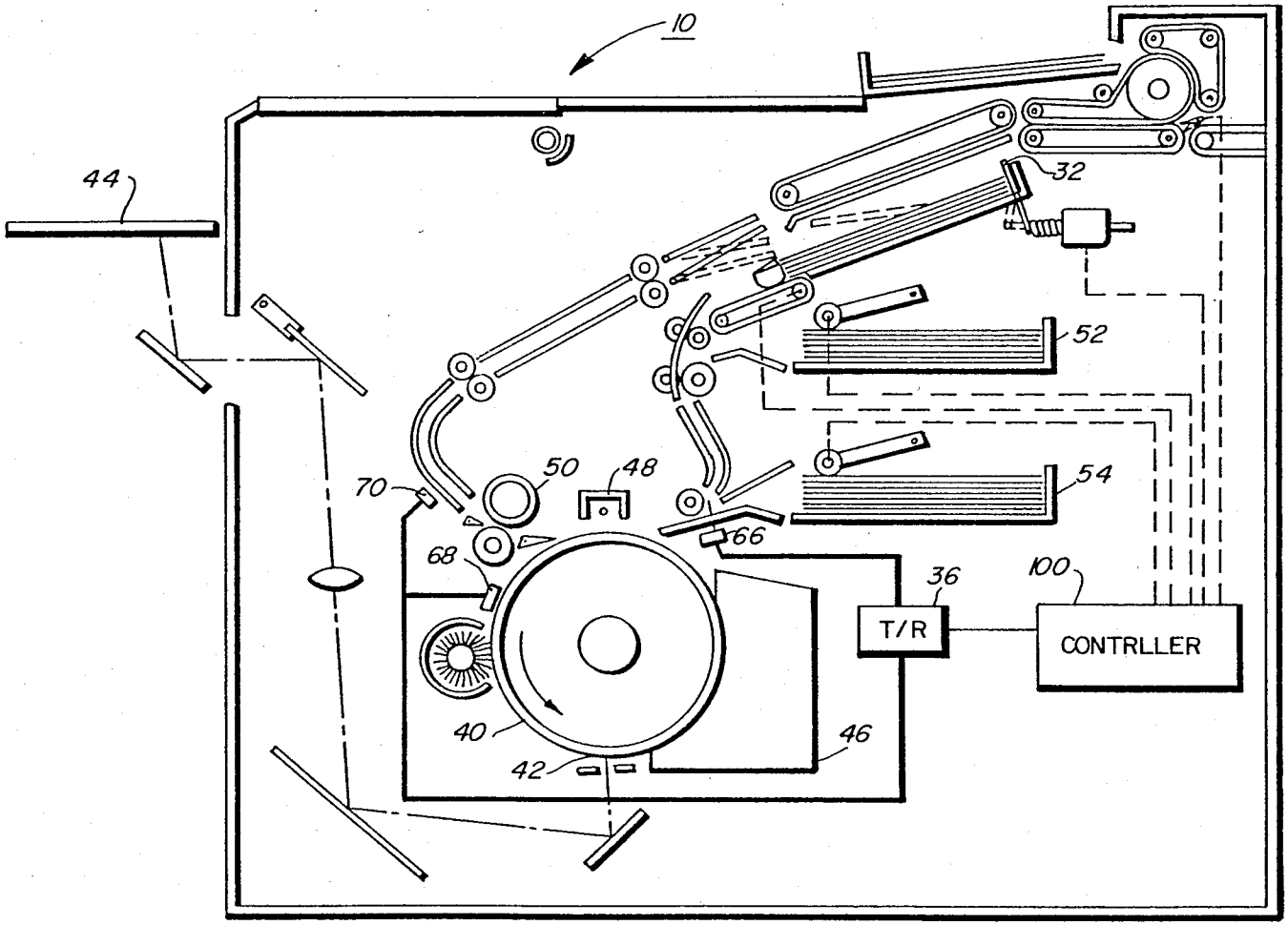
* and FIG. 4 illustrates a typical machine environment incorporating the present invention.

With reference to FIG. 4, there is illustrated a printing machine incorporating the present invention. In particular, there is shown a photoreceptor 40 rotating in a counterclockwise direction. The photoreceptor 40 rotates through an optic station 42 for projecting an image of an object on platen 44 onto the photoreceptor surface. The photoreceptor then rotates to a developing station 46 and then to a transfer station 48 to transfer the toner image to one side of a copy sheet. The copy sheet with the toner image is then fused at the fusing station 50. Copy sheets are provided from one of two copy sheet trays 52 or 54. Copy sheet detectors are disposed along the copy sheet path at various locations, detectors 66, 68 and 70 being representative. In a preferred emodiment, the detectors 66, 68 and 70 correspond to ports 21, 22 and 23 as illustrated in FIG. 1*a*, ports 40, 42 and 44 illustrated in FIG. 2*a*, or ports A, B and C illustrated in FIG. 3*a*. The ports are connected through a suitable acoustic wave guide to transmitter/receiver 36 disposed near the detectors and electrically connected to the controller 100.

In operation, as the copy sheets from either tray 52 or 54 are conveyed along the paper path, past detector 66 prior to image transfer to transfer station 48. After transfer, the copy sheet is delivered to fuser 50 and then conveyed past detector 70. A copy sheet that fails to be guided into the fuser 50 and remains on the photoreceptor is sensed by detector 68. It should be noted that various port locations could be provided throughout the machine to detect the presence or absence of any type of obstruction.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In a sheet transport system for conveying a sheet along a path, a sheet sensor comprising an elongated acoustic cavity, said cavity having a plurality of spaced ports, said ports being disposed along said path, the cavity comprising a transmitter portion having a plurality of orifices and a receiver portion having a plurality of orifices, each of the transmitter orifices being aligned with a receiver orifice, said aligned orifices providing said ports, an acoustic transmitter attached to one end of the acoustic cavity for generating sound waves in the cavity, and an acoustic receiver responsive to the sound generating means for detecting changes in the sound waves at each of the ports in response to a sheet being present at the port wherein, in the absence of a sheet at a given port, a sound wave is transmitted from the transmitter through the transmitter orifice to the receiver orifice of the receiver portion of the acoustic cavity to the receiver.

2. The sheet sensor of claim 1 wherein if a sheet is present at a given orifice, the acoustic wave generated by the transmitter to the transmitter orifice corresponding to said given orifice is reflected at the orifice by said sheet.

3. In a sheet transport system for conveying a sheet along a path, a sheet sensor comprising an elongated acoustic cavity, said cavity having a plurality of spaced orifices, said orifices being disposed along said path, an acoustic transmitter attached to one end of the acoustic cavity for generating sound waves in the cavity, and an acoustic receiver attached to said one end of the cavity for detecting changes in the reflected sound waves at each of the orifices in response to a sheet being present at the orifice.

4. A sensor system for detecting the presence or absence of objects comprising an elongated acoustic cavity, said cavity having a plurality of spaced ports, an acoustic transmitter attached to one end of the acoustic cavity for generating sound waves in the cavity, and means for detecting changes in the reflected sound waves at one of the ports in response to the presence or absence of an object at said one port.

5. The sensor system of claim 4 wherein the sound generating means is an acoustic transmitter and the means responsive is an acoustic receiver, and wherein the elongated acoustic cavity comprises a transmitter portion having a plurality of orifices and a receiver portion having a plurality of orifices, each of the transmitter orifices being aligned with a receiver orifice, said aligned orifices providing said ports.

6. The sensor system of claim 5 wherein, in the absence of an object in a given port, a sound wave is transmitted from the transmitter through the transmitter orifice to the receiver orifice of the receiver portion of the acoustic cavity to the receiver.

7. The sensor system of claim 6 wherein if a sheet is present at a given port, the acoustic wave generated by the transmitter to the transmitter orifice corresponding to said given port is reflected at the orifice by said object.

8. The sensor system of claim 4 wherein said acoustic transmitter and means responsive is a single device disposed at one end of the elongated acoustic cavity, said means responsive detecting an inverted signal from a port in response to an object being disposed adjacent said port.

9. The sensor system of claim 4 wherein said acoustic transmitter and said means responsive are piezoelectric devices.

10. The sensor system of claim 4 including a transport system for conveying sheets along a path, for detecting the presence or absence of sheets along the path.

11. In a sheet paper transport system having means for conveying sheets along a predetermined sheet path, the combination of an elongated acoustic wave guide, an acoustic transmitter disposed at one end of the acoustic wave guide for generating sound waves in the wave guide, an acoustic receiver disposed along the acoustic wave guide for receiving sound waves conveyed along the wave guide, and a plurality of ports disposed along the elongated acoustic waveguide, the acoustic receiver detecting the presence or absence of a sheet at each of the ports.

* * * * *